US009187210B2

(12) United States Patent
Zhu et al.

(10) Patent No.: US 9,187,210 B2
(45) Date of Patent: Nov. 17, 2015

(54) TWO STAGE DRAW LATCH FOR STACKABLE STORAGE BOX WITH REMOVABLE COVER

(71) Applicants: Shengbo Zhu, San Jose, CA (US); Su Shiong Huang, Bellevue, WA (US)

(72) Inventors: Shengbo Zhu, San Jose, CA (US); Su Shiong Huang, Bellevue, WA (US)

(73) Assignee: MICRODATA CORPORATION, San Jose, CA (US)

( * ) Notice: Subject to any disclaimer, the term of this patent is extended or adjusted under 35 U.S.C. 154(b) by 167 days.

(21) Appl. No.: 13/987,352

(22) Filed: Jul. 16, 2013

(65) Prior Publication Data

US 2015/0021328 A1 Jan. 22, 2015

(51) Int. Cl.

| | |
|---|---|
| ***B65D 21/036*** | (2006.01) |
| ***B65D 21/02*** | (2006.01) |
| ***E05C 19/14*** | (2006.01) |
| ***B65D 45/02*** | (2006.01) |
| *E05B 65/52* | (2006.01) |

(52) U.S. Cl.

CPC ..... *B65D 21/0217* (2013.01); *B65D 45/02* (2013.01); *E05C 19/14* (2013.01); *B65D 21/0223* (2013.01); *E05B 65/52* (2013.01); *Y10T 292/0917* (2015.04)

(58) Field of Classification Search

CPC ..... B65D 21/0226; B65D 21/023; B65D 21/0217; B65D 45/02; G08B 13/14; H02B 1/26; Y10T 292/0917; E05C 19/14; E05B 65/52

USPC ..... 220/324

See application file for complete search history.

(56) References Cited

U.S. PATENT DOCUMENTS

| | | | | |
|---|---|---|---|---|
| 3,384,259 | A * | 5/1968 | Hoffstadt | 220/4.27 |
| 4,078,701 | A * | 3/1978 | Clubb | 222/130 |
| 4,760,921 | A * | 8/1988 | Licari | 206/504 |
| 5,086,926 | A * | 2/1992 | Paige et al. | 206/542 |
| D365,969 | S * | 1/1996 | Sellman | D7/608 |
| 6,273,258 | B1 * | 8/2001 | Piacenza | 206/503 |
| 6,874,634 | B2 * | 4/2005 | Riley | 206/439 |
| 7,510,096 | B2 * | 3/2009 | Wang | 220/4.26 |
| 8,602,217 | B2 * | 12/2013 | Sosnovsky et al. | 206/508 |
| 8,813,960 | B2 * | 8/2014 | Fjelland | 206/503 |

* cited by examiner

*Primary Examiner* — Stephen Castellano

(57) ABSTRACT

A dual function two stage draw latch has a first stage loop member pivotally attached at one end to a latch lever pivotally mounted to a base member secured to a wall of a first container. A second stage loop member is pivotally attached to the other end of the first stage loop member. The free end of the second stage loop member is able to engage a catch mounted on a wall of a second container stacked on top of the first container to provide a holding force for the two containers. This free end is also able to engage a catch element mounted on a container lid to hold the lid in place. Electrically conductive strips interconnect the latch and catch to provide electrical interconnection between the containers.

14 Claims, 12 Drawing Sheets

TWO STAGE DRAW LATCH FOR STACKABLE STORAGE BOX WITH REMOVABLE COVER

BACKGROUND OF THE INVENTION

This invention relates in general to storage containers. More particularly, this invention relates to storage containers which have removable lids and which are capable of being stacked on top of one another.

Stackable storage containers with removable lids are well known and have been widely used for the storage of many different types of items, including documents, file folders containing documents, mechanical parts, and various objects. A typical storage container of this type consists of two main parts: a box-like structure and a removable lid usually fabricated from the same material, such as plastic or sheet metal.

When such containers are stacked on top of each other, it is frequently desirable to provide some type of mechanism to hold the stacked individual containers together in order to provide mechanical stability to the array. When the stacked containers are held together, the lids on all but the upper-most container are held in place by the vertical holding force applied to the containers by the holding mechanism. The lid of the upper-most container, however, experiences no such holding force and must be provided with some mechanism to secure the lid to its container.

A common single stage draw latch and complementary catch combination might be used as the mechanism to hold together the individual containers in a stacked configuration. This requires that the draw latch be mounted on each container near the upper margin of a wall and the complementary catch be mounted near the lower margin of the same wall so that the latch loop of a lower container draw latch can engage the catch of the upper adjacent container. While such an arrangement might suffice to perform the function of providing the vertical force required to hold together the stacked containers, it could not be used to secure the lid of the uppermost container due to the fact that a latch loop capable of engaging the catch of an upper adjacent container cannot effectively engage a catch mounted on the lid of the container on which the latch is mounted. Consequently, either some other latching arrangement must be provided or a container must be specially designed to function as the upper-most container and provided with some other type of mechanism to secure to lid to the container.

Some stackable storage containers are constructed according to a unique design for enabling remote electronic searching for objects, such as file folders and documents within such file folders, located somewhere within a collection of storage containers. Commonly assigned pending U.S. patent application Ser. No. 13/694,829 filed Jan. 8, 2013 for "Storage Container For Electronically Addressable File Folders And Documents", the disclosure of which is hereby incorporated by reference, discloses such a container design. Each container is provided with a pair of electrically conductive support rails mounted in the interior near the top margin. The rails are laterally spaced by an amount designed to receive the ends of support braces incorporated into file folders removably placed within the container to provide both mechanical support for the file folders and electrical connections to circuitry including an address decoder located within the file folder support braces. A circuit board is mounted in the container and contains electronic circuitry for receiving unique address signals supplied by a host computer which identify a folder or document to be located. The rails are individually coupled to the electronic circuitry: one of the rails receives the address signals and supplies them to all file folders residing in the container; the other rail furnishes response signals from the file folders to the electronic circuitry of the container circuit board. Each container also has a visible indicator coupled to the electronic circuitry which is illuminated whenever the address signals specify a file folder or document located in that container. An input connector and an output connector are mounted on the container: the input connector receives the address signals from the host computer via a local controller; the output connector couples address signals from one container to another container.

FIG. 1 illustrates a stacked array of such storage containers. As seen in this Fig., a plurality of storage containers 10-1, 10-2, . . . , 10-6 are stacked in a vertical array. Each container has an input connector 16-1, 16-2, . . . , 16-6; and an output connector 14-1, 14-2, . . . , 14-6. A local controller 18 receives address signals from a remote host computer (not shown) and supplies these signals to one of the containers 10-1 by means of input cable 19 and input connector 16-1 of container 10-1. The address input signals are coupled to the remaining containers in the stack by means of jumper cables 12-1, 12-2, . . . , 12-5 which are individually connected between the output connector of one container to the input connector of the adjacent container.

The arrangement of FIG. 1 has no provision for holding together the individual containers or for securing the lid of the uppermost container. In addition, the requirement for individually electrically coupling together the individual containers with jumper cables 12*i* is less than optimal since it requires the installer to manually connect the jumper cables to the respective input and output connectors.

SUMMARY OF THE INVENTION

The invention comprises a two stage latch which can perform the dual functions of providing a holding force for stacked storage containers and a securing force for the lid of an uppermost storage container in a stack of containers when mounted to a wall of a container. Further, the two stage latch also functions as part of an electrically conductive path which eliminates the need for jumper cables in a stacked array of containers. The two stage latch functions in concert with a complementary catch to provide the container holding force and also functions in concert with a catch element provided on the uppermost container lid to provide the securing force for the lid.

In a broadest aspect, the invention comprises a dual function two stage draw latch for providing a holding force between two stacked containers and a force for securing a lid to a container. The latch comprises a base member; a latch lever pivotally mounted to the base member; a first stage loop member having a first end pivotally secured to the latch lever and a second end; and a second stage loop member having a first end pivotally secured to the second end of the first stage loop member and a free end engageable with an associated catch means. The catch means may comprise a complementary catch having a lip releasably engageable with the free end of the second stage loop member, and a catch element formed in a container lid and releasably engageable with the free end of said second stage loop member. The dual function two stage draw latch is preferably intended for use with a storage container as part of a latch/catch mechanism for providing a holding force between two stacked containers and a force for securing a lid to the storage container. The storage container has a base wall, and a plurality of upstanding wall members connected to the base wall, the wall members each having an upper margin and a lower margin. The two stage draw latch is secured to one of the wall members adjacent the upper margin thereof. A catch member is secured to the same one of the wall members adjacent the lower margin thereof, the catch member having a base member with a lip releasably engageable with a latch loop. The latch and the catch member are preferably fabricated from an ohmic electrically conductive material and are arranged on the wall member in substantially vertical alignment. An ohmic electrically conductive element extends between the draw latch and the catch member to electrically interconnect these two elements.

A container lid has a catch element preferably formed in the container lid and located at a position in which the free end of the second stage loop member is releasably engageable therewith so as to provide a force for securing the container lid to the upper margin of the container wall member.

In one embodiment, an additional two stage draw latch is secured to a different one of the wall members adjacent the upper margin thereof, and an additional catch member is secured to the different one of the wall members adjacent the lower margin thereof. Preferably, the one of the wall members and the different one of the wall members are oppositely facing wall members.

When the container is provided with the additional latch, the container lid has a first catch element located at a position in which the free end of the second stage loop member of the latch is releasably engageable therewith and a second catch element located at a position in which the free end of the second stage loop member of the additional latch is releasably engageable therewith so as to provide a force for securing the container lid to the upper margin of both the one wall member and the different one of the wall members.

In the dual latch/catch member arrangement, the latch and the catch member are secured to the one of the wall members in substantially vertical alignment; and the additional latch and the additional catch member are secured to the different one of the wall members in substantially vertical alignment.

In an alternate embodiment configured to prevent incorrect electrical connections between stacked containers, one of the walls is provided with a single latch and a single catch member, while the different (preferably opposite) wall is provided with a laterally spaced pair of latches and catch members. In this embodiment, the container lid is provided with a matching catch elements preferably formed in the lid from the same material as the lid material so that each latch has an associated catch element.

For a fuller understanding of the nature and advantages of the invention, reference should be made to the ensuing detailed description taken in conjunction with the accompanying drawings.

DETAILED DESCRIPTION OF THE PREFERRED EMBODIMENTS

Figure 1:
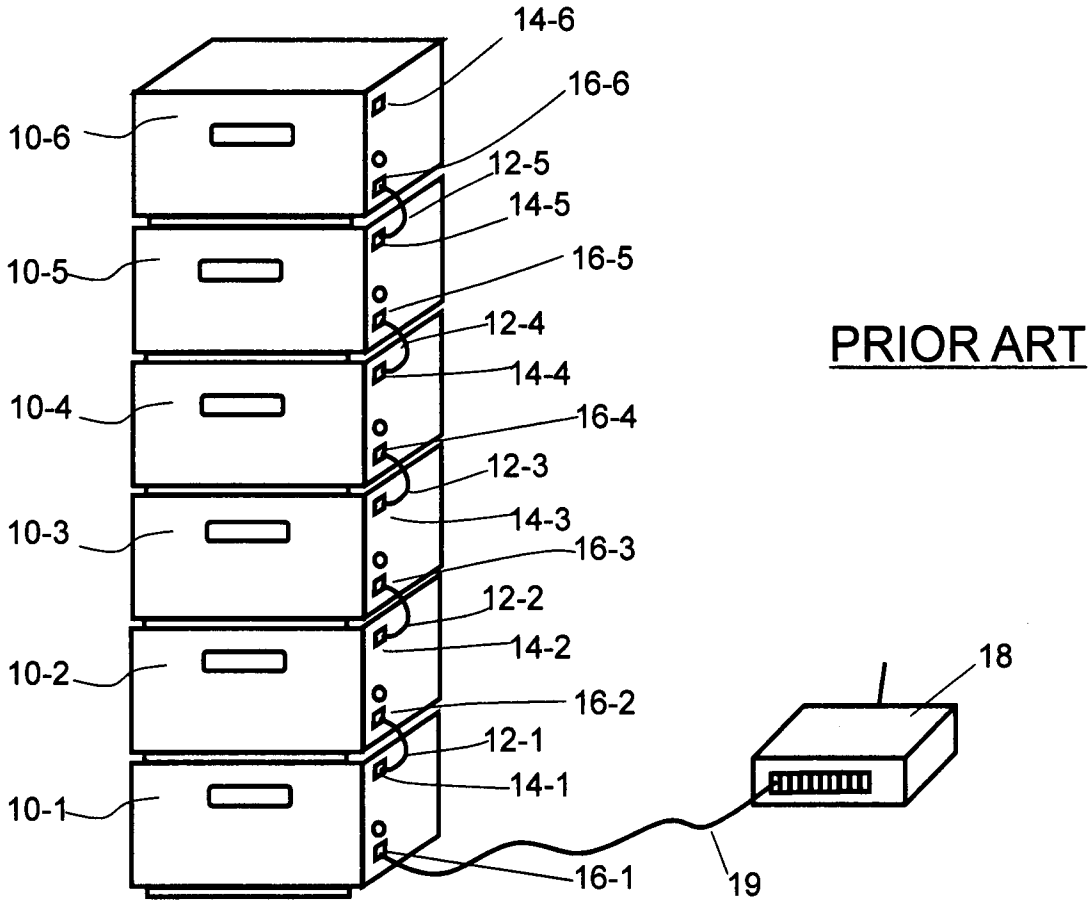
FIG. 1 is a schematic perspective view illustrating the stacked configuration of a plurality of storage containers and a controller, with the storage containers electrically interconnected using cables.
Figure 2:
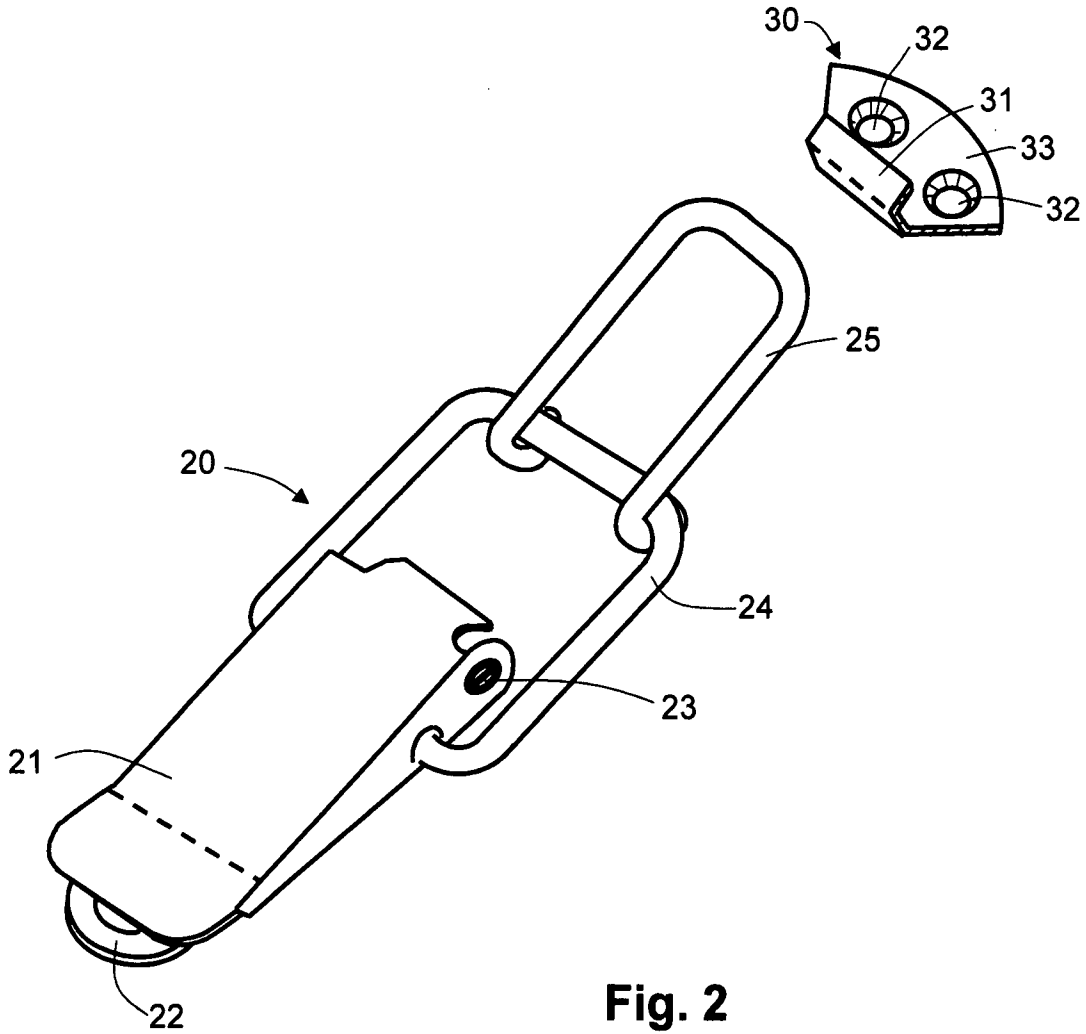
FIG. 2 is a perspective view of a two stage draw latch and complementary catch according to the invention.

Turning now to the drawings, FIG. 2 is a perspective view of a two stage draw latch 20 and a complementary catch 30 according to the invention. As seen in this Fig., latch 20 includes a latch lever 21 pivotally attached to a base member 22 by means of a pivot member 23. A first stage loop member 24 is pivotally secured to latch lever 21, and a second stage loop member 25 is pivotally secured to the opposite end of first stage loop member as shown. The pivot points of latch lever 21 and first stage loop member 24 are displaced longitudinally of latch lever 21 and base member 22 so that first and second stage loop members 24, 25 are displaced outwardly of the longitudinal axis of latch 20 when lever 21 is manipulated towards the open position. When lever 21 is manipulated towards the closed position, first and second stage loop members 24, 25 are retracted inwardly of the longitudinal axis of latch 20. Complementary catch 30 includes a catch lip 31 and a pair of chamfered holes formed in a base member 33. The width of catch lip 31 is less than the inner spacing of the longitudinal leg portions of second stage loop member 25 so that the free end of second stage loop member 25 can be secured within catch lip 31 of catch 30 when the latch 20 is in the latched position illustrated. When latch 20 is manipulated to the unlatched position, first and second stage loop members 24, 25 are positioned such that the free end of second stage loop member clears catch lip 31 and can be engaged with and disengaged therefrom. Latch lever 21, latch base member 22, first stage loop member 24, second stage loop member 25 and catch 30 are all fabricated from ohmic electrically conductive material so that electrical current can flow between latch 20 and catch 30 when these two elements are mechanically engaged.

Figure 3:
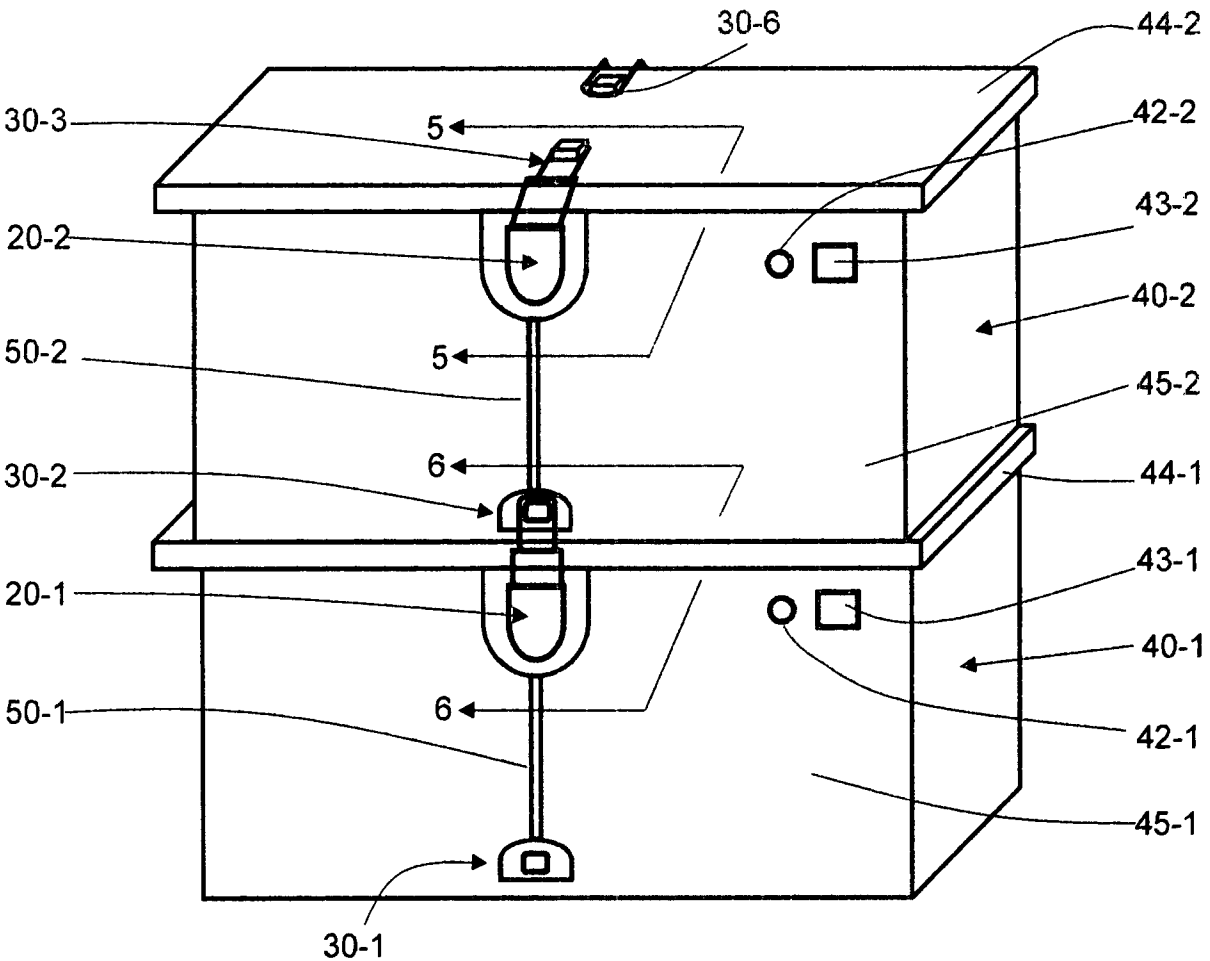
FIG. 3 is a perspective front view illustrating two stacked and latched storage containers.
Figure 4:
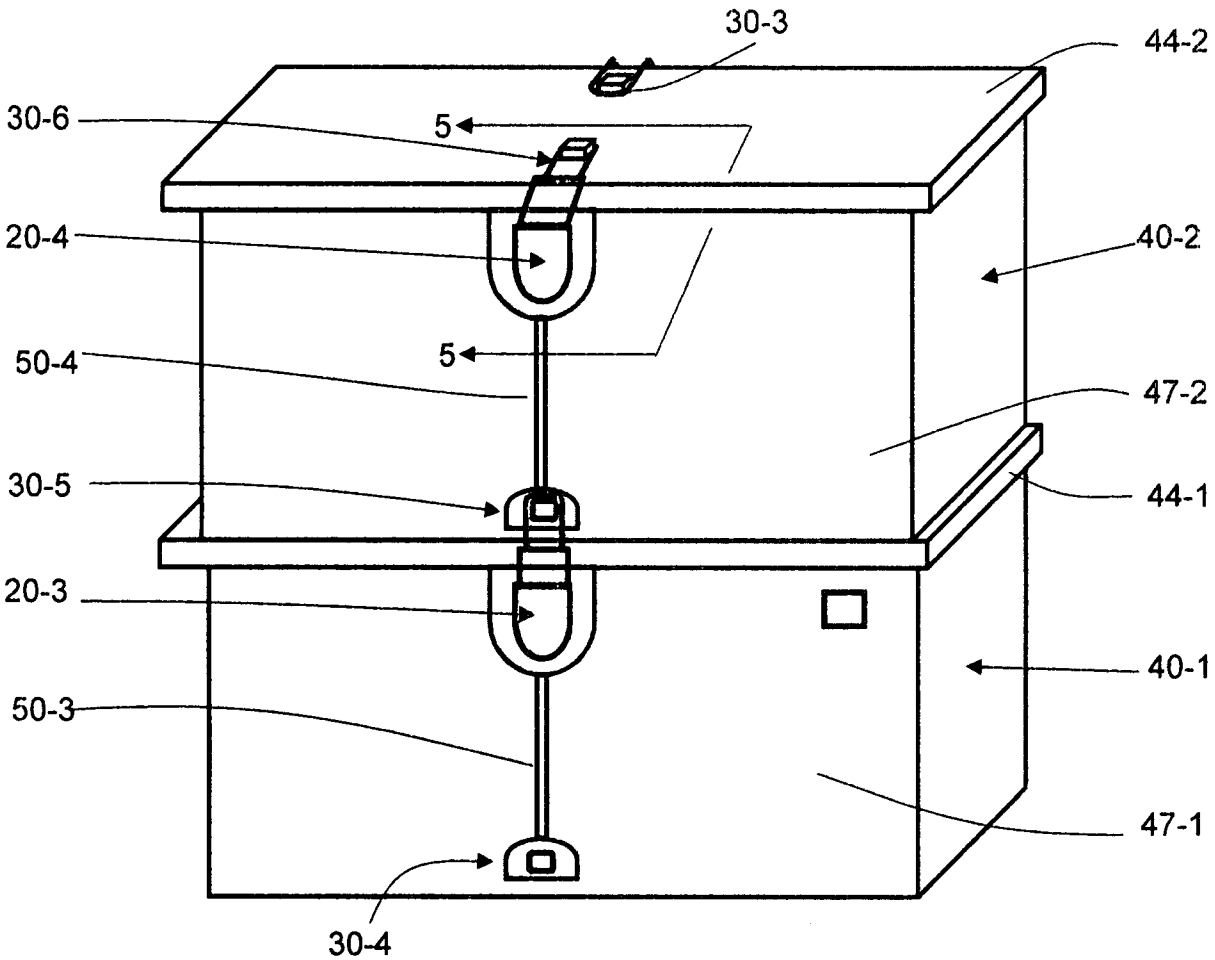
FIG. 4 is a perspective rear view illustrating the same two stacked and latched storage containers of FIG. 3.

Two stage draw latch 20 is a dual purpose latch which can be used to secure two storage containers together when stacked and to secure a removable lid to a storage container. This dual functionality is illustrated in FIGS. 3 and 4 which are, respectively, a perspective front view illustrating two stacked and latched storage containers and a perspective rear view illustrating the same two stacked and latched storage containers. With reference to FIG. 3, a lower storage container 40-1 has a catch 30-1 mounted on front container wall 45-1 near the bottom thereof and a latch 20-1 mounted on front container wall 45-1 near the top thereof. Latch 20-1 and catch 30-1 are preferably arranged in substantially vertical alignment. A light source 42-1 and an input connector 43-1 are also mounted on front container wall 45-1. An electrically conductive strip 50-1 is connected between catch 30-1 and latch 20-1 for a purpose to be described. Similarly, an upper storage container 40-2 has a catch 30-2 mounted on front container wall 45-2 near the bottom thereof and a latch 20-2 mounted on front container wall 45-2 near the top thereof. Latch 20-2 and catch 30-2 are preferably arranged in substantially vertical alignment. An electrically conductive strip 50-2 is connected between catch 30-2 and latch 20-2 for a purpose to be described. Latch 20-1 of lower container 40-1 is engaged with catch 30-2 of upper container 40-2 to provide a force securing the two containers together. Latch 20-2 of upper container 40-2 is engaged with a catch element 30-3 provided on a removable lid 44-2 for upper container 40-2. A removable lid 44-1 arranged on the top of lower container 40-1 is secured in place by the holding force provided by latch 20-1 and catch 30-2. As shown in FIG. 4, a similar latch/catch arrangement is provided for the rear walls of the lower and upper storage containers. Thus, lower storage container 40-1 has a catch 30-4 mounted on rear container wall 47-1 near the bottom thereof and a latch 20-3 mounted on rear container wall 47-1 near the top thereof. Latch 20-3 and catch 30-4 are preferably arranged in substantially vertical alignment. An electrically conductive strip 50-3 is connected between catch 30-4 and latch 20-3 for a purpose to be described. Similarly, upper storage container 40-2 has a catch 30-5 mounted on front container wall 47-2 near the bottom thereof and a latch 20-4 mounted on rear container wall 47-2 near the top thereof. Latch 20-4 and catch 30-5 are preferably arranged in substantially vertical alignment. An electrically conductive strip 50-4 is connected between catch 30-5 and latch 20-4 for a purpose to be described. Latch 20-3 of lower container 40-1 is engaged with catch 30-5 of upper container 40-2 to provide a force securing the two containers together. Latch 20-4 of upper container 40-2 is engaged with a catch element 30-6 provided on removable lid 44-2 of upper container 40-2. Removable lid 44-1 arranged on the top of lower container 40-1 is secured in place by the holding force provided by latch 20-3 and catch 30-5. The combined action of the latches, catches and lid catch elements provides a mechanically stable array of two stacked containers with the lid of the upper container positively secured in place.

Figure 5:
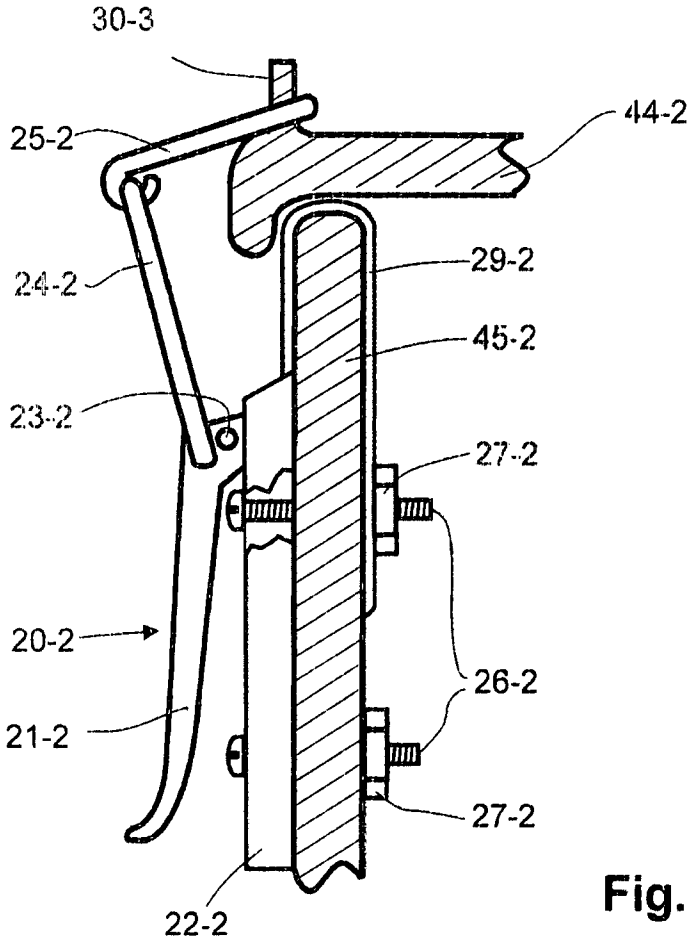
FIG. 5 is an enlarged sectional view taken along lines 5-5 of FIG. 3 illustrating the latched position of the two stage draw latch and a catch element formed on a container lid.

FIG. 5 is an enlarged sectional view taken along lines 5-5 of FIG. 3 illustrating the latched position of the two stage draw latch and the catch element 30-3 formed on container lid 44-2. As seen in this Fig., latch 20-2 is secured to front container wall 45-2 by means of mounting bolts 26-2 which pass through apertures formed in base member 22-2 and corresponding apertures (not shown) formed in front container wall 45-2 and are secured in place by fasteners 27-2 (illustrated as threaded nuts). A stiffener plate 29-2 is preferably provided to add strength to the arrangement. In the illustrated latched position, the free end of second stage loop member 25-2 is engaged with catch element 30-3 of lid 44-2. Preferably, catch element 30-3 is an integrally formed protrusion extending in a generally upward direction from the top surface of lid 44-2. If desired, catch element 30-3 may extend upwardly and inwardly of the top surface of lid 44-2 to more securely capture the free end of second stage loop member 25-2. The double articulation afforded by first stage loop member 24-2 and second stage loop member 25-2 ensures sufficient freedom of movement to enable the free end of second stage loop member 25-2 to achieve the position illustrated when latched and to be easily released during unlatching.

Figure 6:
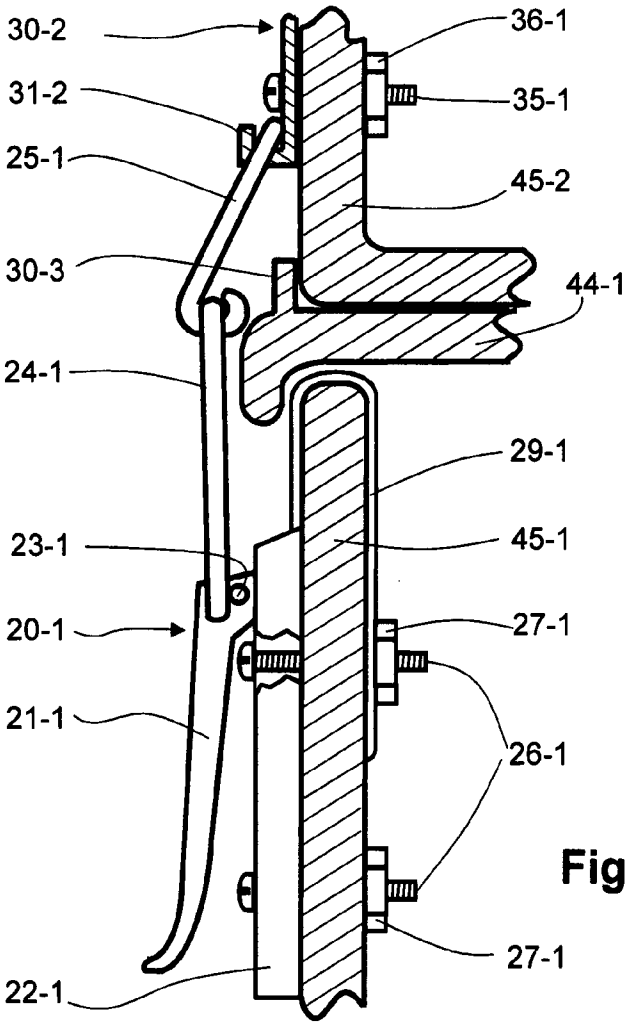
FIG. 6 is an enlarged sectional view taken along lines 6-6 of FIG. 3 illustrating the latched position of the two stage draw latch mounted on the front wall of a first container and a catch mounted on the front wall of a second container.

FIG. 6 is an enlarged sectional view taken along lines 6-6 of FIG. 3 illustrating the latched position of the two stage draw latch mounted on the front wall of a first container and a catch mounted on the front wall of a second container. As seen in this Fig., latch 20-1 is secured to front container wall 45-1 by means of mounting bolts 26-1 which pass through apertures formed in base member 22-1 and corresponding apertures (not shown) formed in front container wall 45-1 and are secured in place by fasteners 27-2 (illustrated as threaded nuts). A stiffener plate 29-1 is preferably provided to add strength to the arrangement. In the illustrated latched position, the free end of second stage loop member 25-1 is engaged with catch lip 31-2 of catch 30-2 mounted on the front wall 45-2 of upper container 40-2 by means of bolts 35-1 and nuts 36-1. As is evident from this Fig., the combined lengths of first stage loop member 24-1 and second stage loop member 25-1 are sufficient to allow the free end of second stage loop member 25-1 to pass upwardly and over catch lip 31-2.

Figure 7:
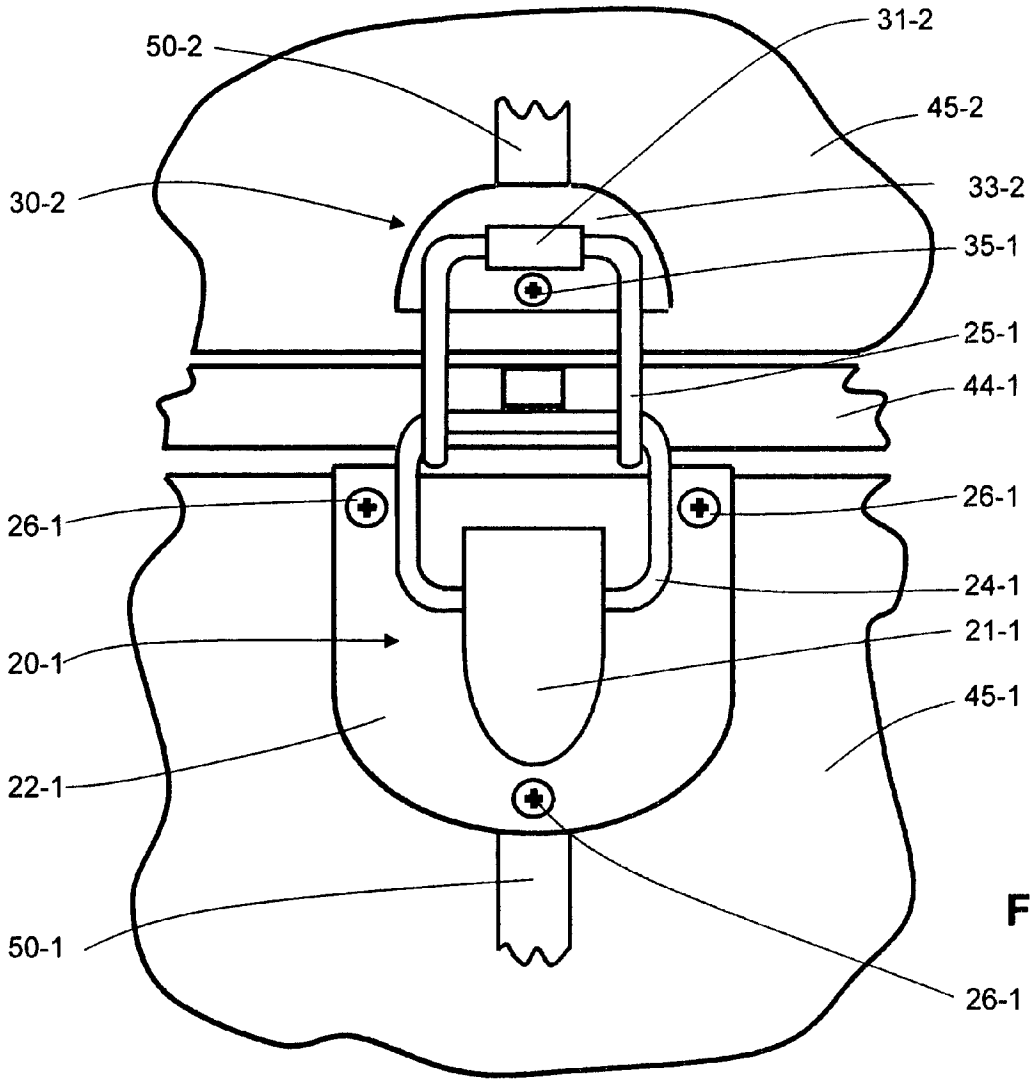
FIG. 7 is an enlarged fragmentary front view of the two stage latch and catch illustrated in section in FIG. 6.

FIG. 7 is an enlarged fragmentary front view of the two stage latch and catch illustrated in section in FIG. 6. In this example, base member 22-1 has lateral dimensions which extend beyond latch lever 21-1 in both lateral directions to provide a more stable base for the latch mechanism. In addition, catch lip 31-2 is formed intermediate the upper and lower margins of base member 33-2. Conductive strip 50-1 is secured to base member 22-1 by means of lower bolt 26-1, while conductive strip 50-2 is secured to base member 33-2 by means of bolt 35-1.

Figure 8:
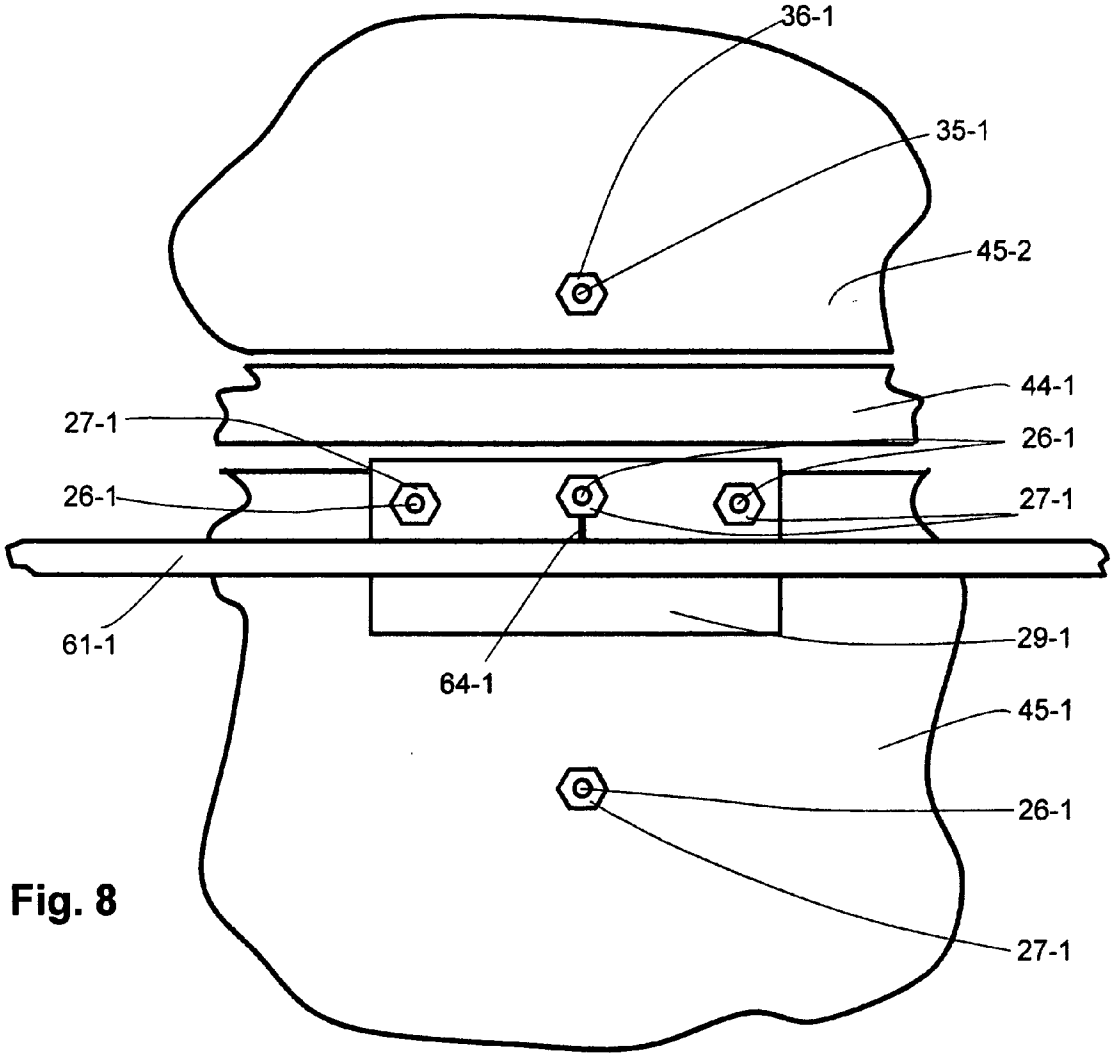
FIG. 8 is an enlarged fragmentary rear view of the two stage latch and catch illustrated in section in FIG. 6.

FIG. 8 is an enlarged fragmentary rear view of the two stage latch and catch illustrated in section in FIG. 6. This Fig. illustrates the relative positioning of bolts 26-1 and fasteners 27-1 and stiffener plate 29-1, as well as an electrical connection 64-1 to be described.

Figure 9:
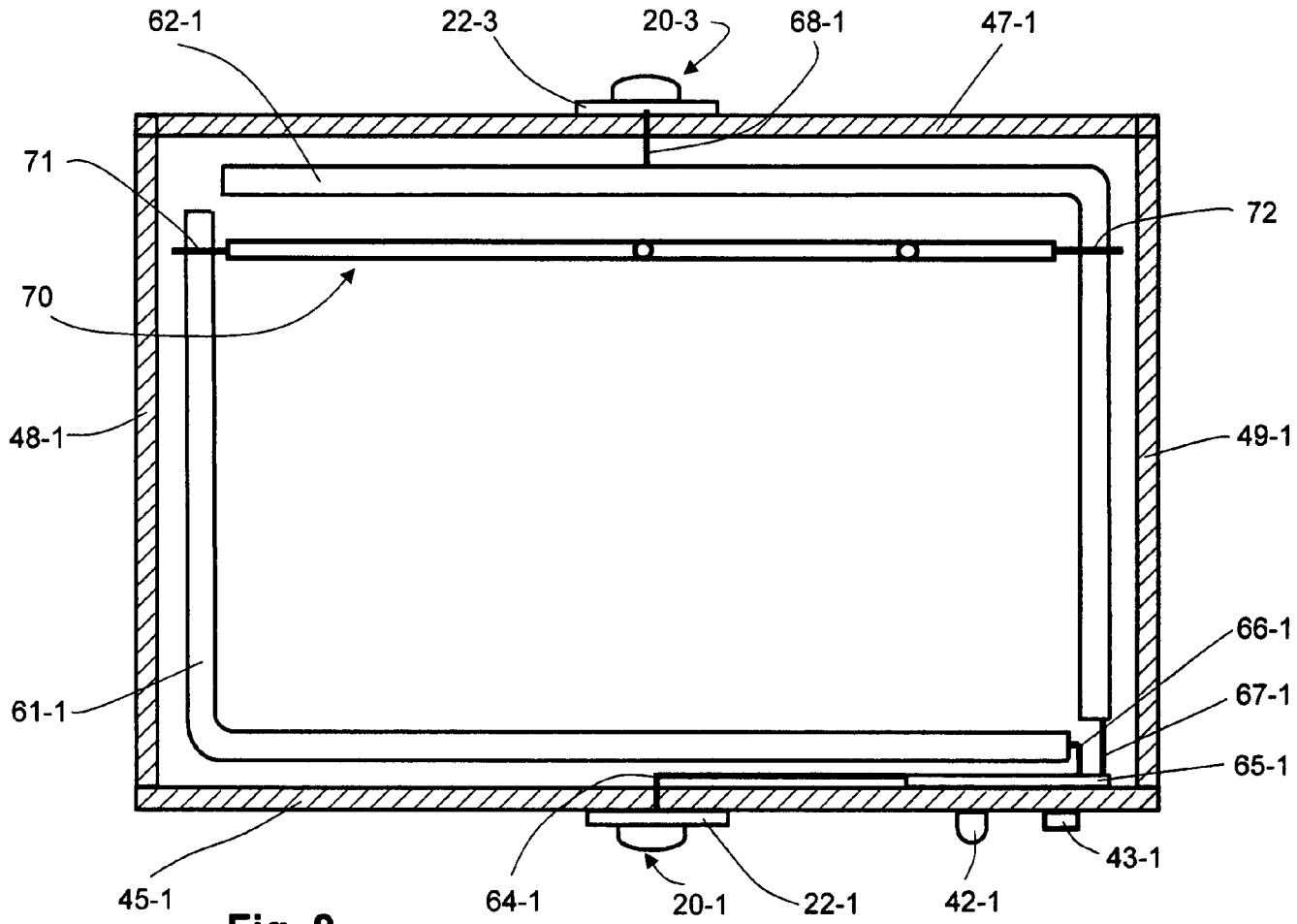
FIG. 9 is a schematic top plan view of a container with the lid removed illustrating the internal mechanical and electrically conductive file folder support components of the storage container of FIGS. 3 and 4.

FIG. 9 is a schematic top plan view of a container with the lid removed illustrating the internal mechanical and electrically conductive file folder support components of one embodiment of the storage containers of FIGS. 3 and 4. As seen in this Fig., a storage container, such as storage container 40-1, has a front wall 45-1, a rear wall 47-1, and two side walls 48-1, 49-1. Mounted within the upper interior of the storage container are a pair of electrically conductive support rails 61-1, 62-1 which are connected to the electronic circuitry incorporated into a circuit board 65-1 by means of ohmic electrical conductors 66-1, 67-1, respectively. Circuit board 65-1 is electrically connected to support rails 61-1, 62-1, light source 42-1, input connector 43-1 and latch base member 22-1, the latter by means of electrical connector 64-1. Rear latch base member 22-3 is electrically connected to support rail 62-1 by electrical conductor 68-1. Support rails 61-1. 62-1 are laterally spaced by a dimension selected to accommodate the support ends 71, 72 of a file folder 70. File folder 70 incorporates the electronic circuitry and functionality of the file folders disclosed in the above-described '829 patent application so that file folder address signals supplied to input connector 43-1 are routed to the circuitry carried by each file folder 70. Support rail 61-1 furnishes incoming address signals to all file folders 70 removably installed in container 40-1, while support rail 62-1 supplies response signals from the circuitry incorporated into all file folders removably installed in container 40-1 to the circuitry on circuit board 65-1. The incoming address signals are also coupled to all interlatched storage containers **40*i* by means of the conductive strips 50-*i*, latches 20-*i*, and catches 30-*i* mounted on the front walls of the containers, while the file folder response signals from all the containers are routed to output circuitry by means of the conductive strips 50-I, latches 20-I, and catches 30**-I mounted on the rear walls of the containers so that no interconnecting cables are needed for a stacked series of storage containers.

Figure 10:
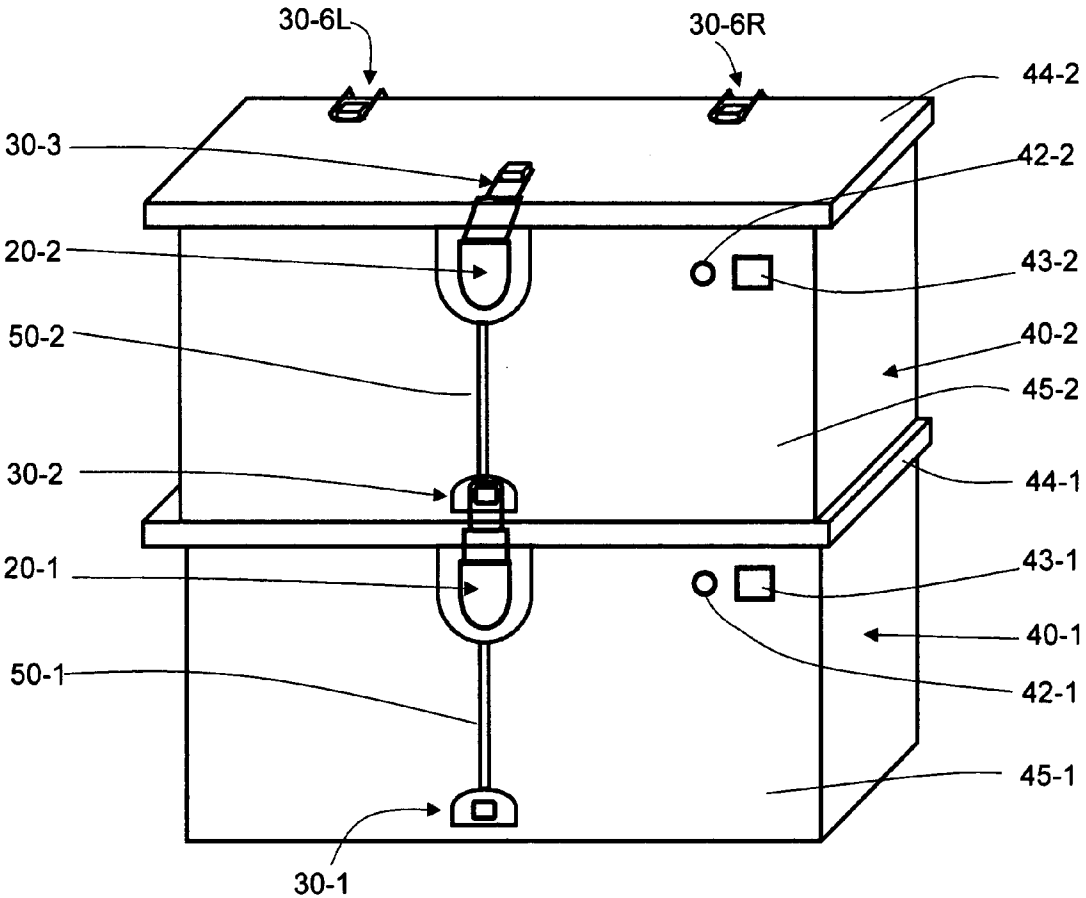
FIG. 10 is a perspective front view illustrating an alternate embodiment of two stacked and latched storage containers.
Figure 11:
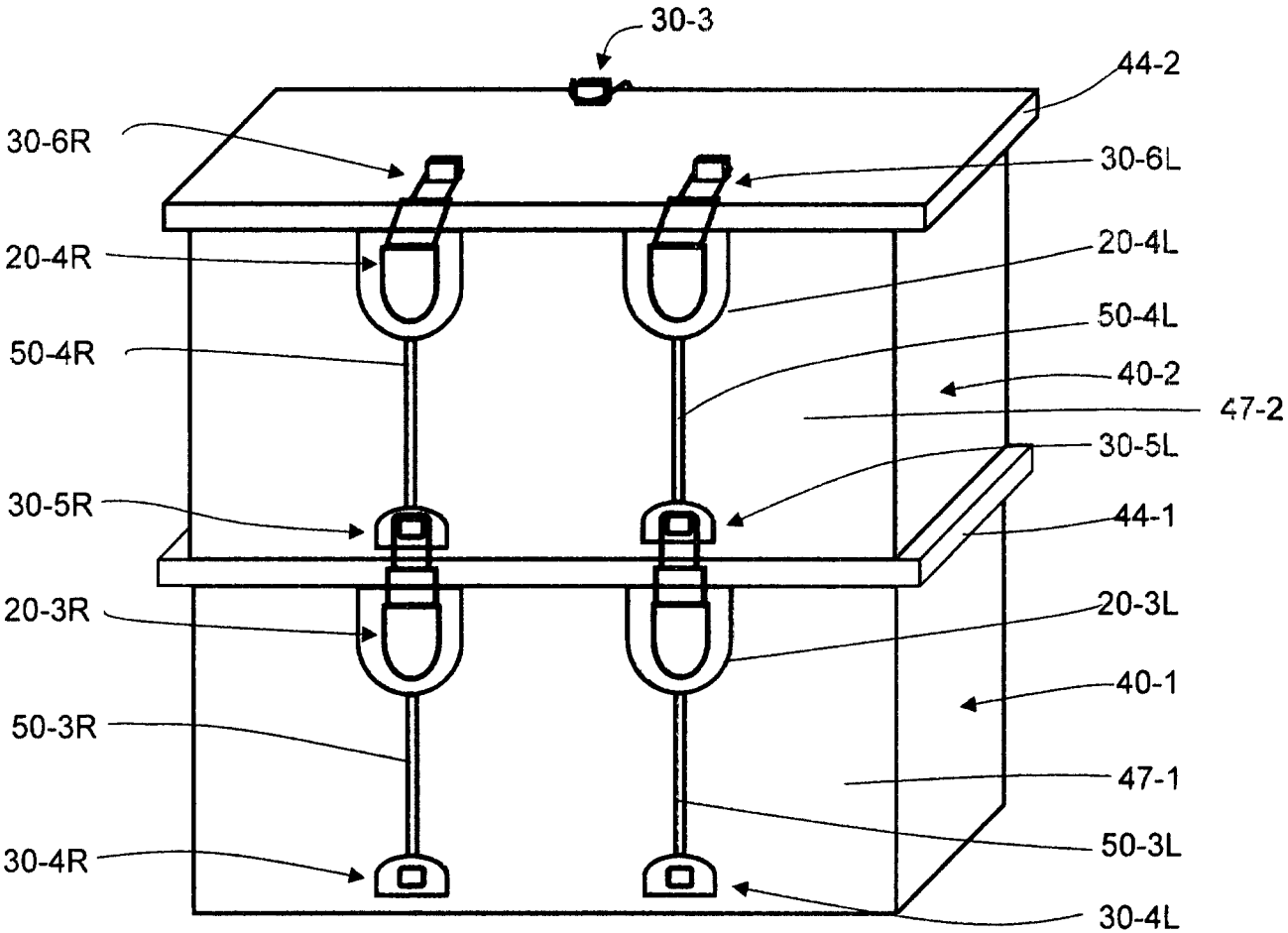
FIG. 11 is a perspective rear view illustrating the same two stacked and latched storage containers of FIG. 10.
Figure 12:
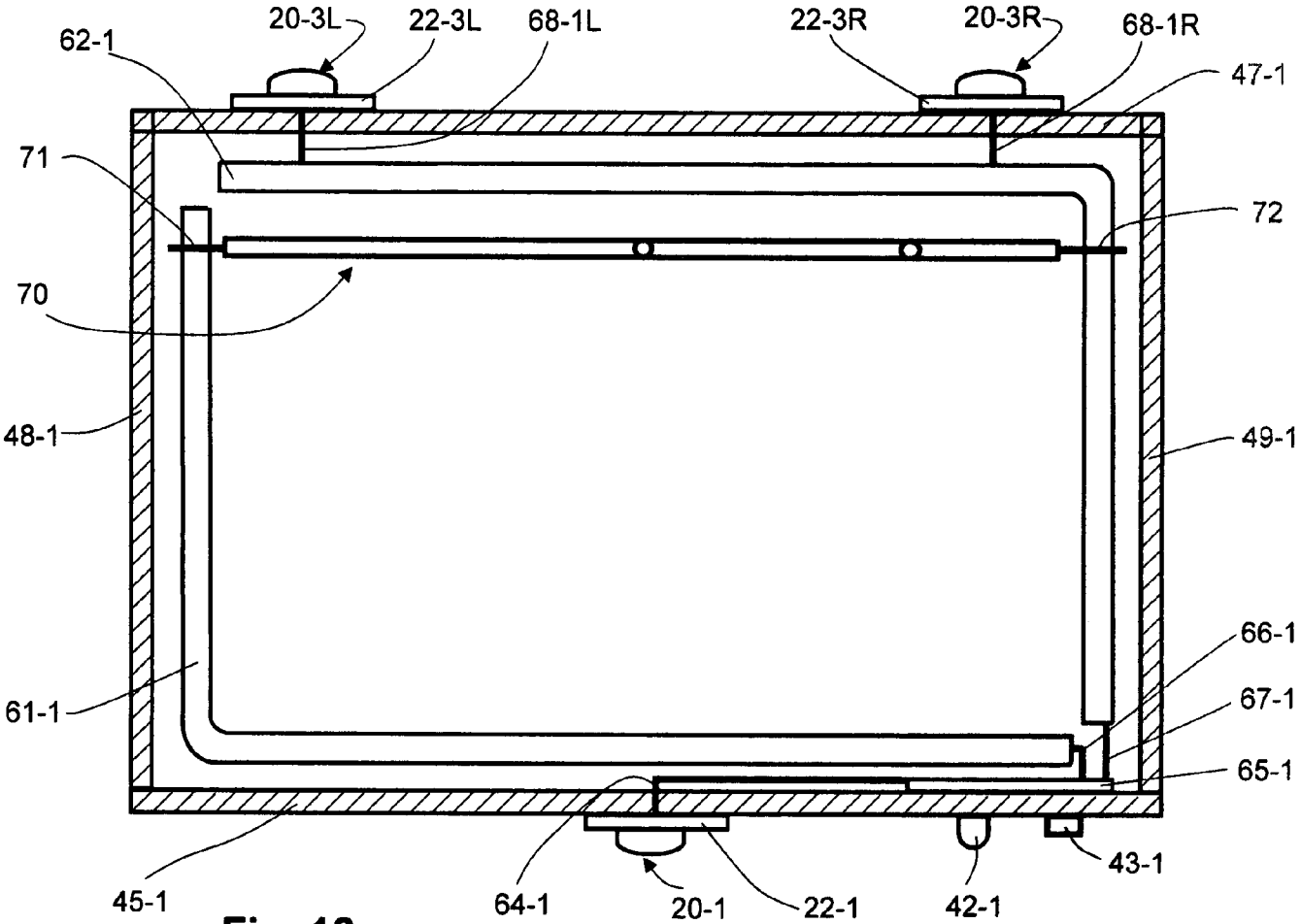
FIG. 12 is a schematic top plan view of the alternate embodiment of a container with the lid removed illustrating the internal mechanical and electrically conductive file folder support components of the storage container of FIGS. 10 and 11.

FIGS. 10-12 illustrate an alternate embodiment of the invention in which provision is made for ensuring that stacked containers are always electrically connected in the correct manner. More specifically, in the embodiment shown in FIGS. 3-9 it is essential that the front walls 45-1, 45-2 be correctly aligned and that the rear walls 47-1, 47-2 be correctly aligned so that the address signals furnished to the input connector 43-*i* of one of the two containers are coupled to the address input support rails 61-1, 61-2 and the response signals are coupled to the output support rails 62-1. 62-2. While this might be accomplished by appropriate visible directional markings, such markings might be ignored or not understood in the field. The alternate embodiment of FIGS. 10-12 provides a complete solution to this potential problem, at a minor cost increase. As seen in these Figs., one of the front and rear walls of each storage container (the rear walls in the specific example shown) is provided with a laterally spaced pair of latches 20-*i*, catches 30-*i* and conductive strips 50-*i*. More specifically, rear walls 47-1, 47-2 are provided with left and right latches 20-3R, 20-3L, 20-4R, 20-4L; and mating left and right catches 30-4R, 30-4L, 30-5R, 30-5L; while the storage container lids 44-1, 44-2 are similarly provided with left and right catch elements (shown in FIG. 11 as catch elements 30-6R, 30-6L for lid 44-2). Conductive strips 50-3R, 50-3L, 50-4R, 50-4L extend between their associated catches and latches. The latch base members 22-*i*L, 22-*i*R of each storage container are both connected to the support rail 62-*i* (see FIG. 12 which illustrates lower storage container latch base members 22-3L, 22-3R connected to support rail 62-1 by conductors 68-1L, 68-1R). Given this asymmetric configuration it is only possible to interconnect stacked containers in the correct orientation.

As will now be apparent, two stage latches fabricated according to the teachings of the invention afford a number of advantages over known single stage latches when used in conjunction with stackable containers with removable lids. Firstly, because of the double articulation provided by the first and second stage loops, the latch can function in concert with a complementary catch to provide a substantial vertical holding force for releasably securing together a number of stacked containers. In addition, the same latch can function in concert with a complementary catch element provided on the lid of a storage container to releasably secure the lid to the container. This eliminates the need for a separate latch/catch mechanism for securing a lid to a container and for dedicating one or more containers to use as an uppermost container in a stacked array. Moreover, when the latch is used in combination with a complementary catch and electrically conductive strips, an array of containers having the electronically addressable functionality can be assembled in a stack without the need for individual cables to electrically interconnect the individual containers. Lastly, when used in combination with a pair of laterally spaced vertically arranged catches and conductive strips, the latch affords a fool-proof method of electrically connecting together an array of stacked containers in the proper way.

Although the above provides a full and complete disclosure of the preferred embodiments of the invention, various modifications, alternate constructions and equivalents will occur to those skilled in the art. For example, while the invention has been described and illustrated as accommodating two storage containers, it is understood that several containers may be stacked on top of one another. Moreover, while the embodiment of FIGS. 10-12 has been described and illustrated as having the dual columns of latches and catches mounted on the rear walls of the storage containers, these dual columns may be mounted on the front walls of the storage containers, if desired, with similar results. Furthermore while the base members of the latches and catches have been described and illustrated with specific shapes, other configurations may be used, depending on the preferences of the individual designer. In addition, while the embodiment of FIGS. 10-12 has been illustrated and described with symmetry about the central vertical axis of the rear wall for the latches and catches mounted on the rear wall of the container, this symmetry is not required. Therefore, the above should not be construed as limiting the invention, which is defined by the appended claims.

What is claimed is:

1. A storage container having a latch/catch mechanism for providing a holding force between two stacked containers and a force for securing a lid to said storage container, said storage container comprising:

a base wall;

a plurality of upstanding wall members connected to said base wall, said wall members each having an upper margin and a lower margin, said base wall and said wall members defining an interior of said container;

an electrically conductive member positioned in said interior for furnishing externally supplied object address signals to objects in said interior of said container;

a two stage draw latch secured to one of said wall members adjacent the upper margin thereof, said latch including a base member, a latch lever pivotally mounted to said base member; a first stage loop member having a first end pivotally secured to said latch lever and a second end; and a second stage loop member having a first end pivotally secured to said second end of said first stage loop member and a free end engageable with an associated catch means; and a catch member secured to said one of said wall members adjacent the lower margin thereof, said catch member having a base member with a lip releasably engageable with a latch loop, said latch base member and said catch base member being fabricated from an ohmic electrically conductive material; and an ohmic electrically conductive element extending between said latch base member and said catch base member and electrically connected therebetween, said electrically conductive member positioned in said interior of said container being electrically coupled to said latch base member.

2. The invention of claim 1 further including a container lid having a catch element located at a position in which said free end of said second stage loop member is releasably engageable therewith so as to provide a force for securing said container lid to said upper margin.

3. The invention of claim 2 wherein said catch element is formed in said container lid.

4. The invention of claim 1 wherein said latch and said catch member are secured to said one of said wall members in substantially vertical alignment.

5. The invention of claim 1 further including:

an additional electrically conductive member positioned in said interior;

an additional two stage draw latch secured to a different one of said wall members adjacent the upper margin thereof, said additional latch including a base member, a latch lever pivotally mounted to said base member of said additional latch; a first stage loop member having a first end pivotally secured to said latch lever of said additional latch and a second end; and a second stage loop member having a first end pivotally secured to said second end of said first stage loop member of said additional latch and a free end engageable with an associated additional catch means;

an additional catch member secured to said different one of said wall members adjacent the lower margin thereof, said additional catch member having a base member with a lip releasably engageable with a latch loop, said additional latch base member and said additional catch base member being fabricated from an ohmic electrically conductive material; and an additional ohmic electrically conductive element extending between said additional latch base member and said additional catch base member and electrically connected therebetween, said additional electrically conductive member positioned in said interior of said container being electrically coupled to said additional latch base member.

6. The invention of claim 5 further including a container lid having a first catch element located at a position in which said free end of said second stage loop member of said latch is releasably engageable therewith and a second catch element located at a position in which said free end of said second stage loop member of said additional latch is releasably engageable therewith so as to provide a force for securing said container lid to said upper margin of said one wall member and said different one of said wall members.

7. The invention of claim 6 wherein said first and second catch elements are formed in said container lid.

8. The invention of claim 5 wherein said latch and said catch member are secured to said one of said wall members in substantially vertical alignment; and wherein said additional latch and said additional catch member are secured to said different one of said wall members in substantially vertical alignment.

9. The invention of claim 5 wherein said one of said wall members and said different one of said wall members comprises oppositely facing wall members.

10. A storage container having a plurality of latch/catch mechanisms for providing a holding force between two stacked containers and a force for securing a lid to said storage container, said storage container comprising:

a base wall;

a plurality of upstanding wall members connected to said base wall, said wall members each having an upper margin and a lower margin, said base wall and said wall members defining an interior of said container;

a first electrically conductive member positioned in said interior for furnishing externally supplied object address signals to objects in said interior of said container;

a second electrically conductive member positioned in said interior;

a first latch secured to one of said wall members adjacent the upper margin thereof, said first latch including a base member, a latch lever pivotally mounted to said base member; a first stage loop member having a first end pivotally secured to said latch lever and a second end; and a second stage loop member having a first end pivotally secured to said second end of said first stage loop member and a free end engageable with an associated catch means;

a first catch member secured to said one of said wall members adjacent the lower margin thereof, said catch member having a base member with a lip releasably engageable with a latch loop, said first latch base member and said first catch base member being fabricated from an ohmic electrically conductive material;

a first ohmic electrically conductive element extending between said first latch base member and said first catch base member and electrically connected therebetween, said first electrically conductive member positioned in said interior of said container being electrically coupled to said first latch base member;

a second latch secured to a different one of said wall members adjacent the upper margin thereof, said second latch including a base member, a latch lever pivotally mounted to said base member of said second latch; a first stage loop member having a first end pivotally secured to said latch lever of said second latch and a second end; and a second stage loop member having a first end pivotally secured to said second end of said first stage loop member of said second latch and a free end engageable with an associated second catch means;

a second catch member secured to said different one of said wall members adjacent the lower margin thereof, said second catch member having a base member with a lip releasably engageable with a latch loop, said second latch base member and said second catch base member being fabricated from an ohmic electrically conductive material;

a second ohmic electrically conductive element extending between said second latch base member and said second catch base member and electrically connected therebetween, said second electrically conductive member positioned in said interior of said container being electrically coupled to said second latch base member;

a third latch secured to said different one of said wall members adjacent the upper margin thereof, said third latch including a base member, a latch lever pivotally mounted to said base member of said third latch; a first stage loop member having a first end pivotally secured to said latch lever of said third latch and a second end; and a second stage loop member having a first end pivotally secured to said second end of said first stage loop member of said third latch and a free end engageable with an associated third catch means;

a third catch member secured to said different one of said wall members adjacent the lower margin thereof, said third catch member having a base member with a lip releasably engageable with a latch loop, said third latch base member and said third catch base member being fabricated from an ohmic electrically conductive material; and a third ohmic electrically conductive element extending between said third latch base member and said third catch base member and electrically connected therebetween, said second electrically conductive member positioned in said interior of said container being electrically coupled to said third latch base member;

said second latch and said second catch member being secured to said different one of said wall members in substantially vertical alignment and said third latch and said third catch member being secured to said different one of said wall members in substantially vertical alignment and laterally spaced from said second latch and said second catch member.

11. The invention of claim 10 wherein said different one of said wall members has a central vertical axis; and wherein said second latch and said second catch member and said third latch and said third catch member are symmetrically spaced about said central vertical axis.

12. The invention of claim 10 further including a container lid having a first catch element located at a position in which said free end of said second stage loop member of said first latch is releasably engageable therewith, a second catch element located at a position in which said free end of said second stage loop member of said second latch is releasably engageable therewith, and a third catch element located at a position in which said free end of said second stage loop member of said third latch is releasably engageable therewith so as to provide a force for securing said container lid to said upper margin of said one of said wall members and said different one of said wall members.

13. The invention of claim 12 wherein said first, second, and third catch elements are formed in said container lid.

14. The invention of claim 10 wherein said one of said wall members and said different one of said wall members comprises oppositely facing wall members.

* * * * *

UNITED STATES PATENT AND TRADEMARK OFFICE

CERTIFICATE OF CORRECTION

PATENT NO. : 9,187,210 B2
APPLICATION NO. : 13/987352
DATED : November 17, 2015
INVENTOR(S) : Zhu et al.

It is certified that error appears in the above-identified patent and that said Letters Patent is hereby corrected as shown below:

on the title page, item (73) Assignee change "MICRODATA CORPORATION" to --iMicrodata Corporation--

Signed and Sealed this
Ninth Day of February, 2016

Michelle K. Lee

Michelle K. Lee
*Director of the United States Patent and Trademark Office*